US009593915B2

(12) United States Patent
Tuggle

(10) Patent No.: US 9,593,915 B2
(45) Date of Patent: Mar. 14, 2017

(54) CONFORMING BANDS, BELTS, AND HOLSTERS WITH INTEGRATED POUCHES

(76) Inventor: Richard Tuggle, San Antonio, TX (US)

( * ) Notice: Subject to any disclaimer, the term of this patent is extended or adjusted under 35 U.S.C. 154(b) by 529 days.

(21) Appl. No.: 13/043,457

(22) Filed: Mar. 8, 2011

(65) Prior Publication Data

US 2011/0220698 A1 Sep. 15, 2011

Related U.S. Application Data

(60) Provisional application No. 61/312,237, filed on Mar. 9, 2010.

(51) Int. Cl.

| | |
|---|---|
| ***F41C 33/02*** | (2006.01) |
| ***F41C 33/00*** | (2006.01) |
| ***F41H 1/02*** | (2006.01) |
| ***A45F 3/14*** | (2006.01) |
| *A45F 3/00* | (2006.01) |

(52) U.S. Cl.

CPC ..... *F41H 1/02* (2013.01); *A45F 3/14* (2013.01); *F41C 33/0209* (2013.01); *F41C 33/0263* (2013.01); *A45F 3/005* (2013.01)

(58) Field of Classification Search

CPC ..... A45F 3/00; A45F 3/005; A45F 2005/026; A45F 2003/144; A45F 2200/0591; A45F 5/00; A45F 2003/008; A45F 3/14; F41C 33/048; F41C 33/0209; F41C 33/0263; Y10S 224/911; A44B 11/22; A45C 1/04

USPC ..... 224/587, 637, 183; 2/321

See application file for complete search history.

(56) References Cited

U.S. PATENT DOCUMENTS

| | | | | | |
|---|---|---|---|---|---|
| 1,478,497 | A * | 12/1923 | Welch | 224/683 | |
| 1,682,450 | A * | 8/1928 | Wanninger et al. | 24/323 | |
| 2,372,971 | A * | 4/1945 | Moore | 224/624 | |
| 3,913,147 | A * | 10/1975 | Ostrander | 2/325 | |
| 4,446,574 | A * | 5/1984 | Kalomeris | 2/338 | |
| 4,694,980 | A * | 9/1987 | Rogers | F41C 33/0227 | 224/238 |
| 4,966,320 | A * | 10/1990 | DeSantis | A45C 1/04 | 224/192 |
| 5,294,031 | A * | 3/1994 | Volpei | A45F 3/00 | 224/192 |
| 5,746,365 | A * | 5/1998 | Scott | 224/676 | |
| 5,803,333 | A * | 9/1998 | Fawcett | A45F 3/00 | 224/148.2 |
| 5,829,653 | A * | 11/1998 | Kaiser | 224/577 | |
| 5,909,834 | A * | 6/1999 | Parrott, III | 224/587 | |
| 5,915,609 | A * | 6/1999 | Diakoulas | 224/626 | |
| 6,155,471 | A * | 12/2000 | Lichtenberger | 224/626 | |
| 6,443,347 | B1 * | 9/2002 | Elizalde et al. | 224/626 | |

(Continued)

FOREIGN PATENT DOCUMENTS

WO WO 2009105854 A1 * 9/2009

*Primary Examiner* — Adam Waggenspack
(74) *Attorney, Agent, or Firm* — John M. Behles

(57) ABSTRACT

Cushioned and conforming body bands, belts, and holsters are provided herein. Some embodiments may include conforming bands that are adapted to surround at least a portion of an individual. The conforming bands may include body portions having an outer surface and an inner surface, the body portion including an integrally formed pouch, the pouch including at least two sidewalls that are spaced apart from one another and joined together along a common bottom edge to define a cavity for receiving a firearm.

19 Claims, 5 Drawing Sheets

(56) References Cited

U.S. PATENT DOCUMENTS

| | | | | |
|---|---|---|---|---|
| 7,562,422 | B2 * | 7/2009 | D'Addario | G10G 5/005 24/701 |
| 7,896,297 | B1 * | 3/2011 | Simone | A61J 9/06 248/102 |
| 2003/0205595 | A1 * | 11/2003 | Young | A45F 5/02 224/230 |
| 2004/0084494 | A1 * | 5/2004 | Gilliam | A45F 3/14 224/583 |
| 2008/0041897 | A1 * | 2/2008 | Malhotra | 224/199 |
| 2008/0190980 | A1 * | 8/2008 | Overton | 224/664 |
| 2008/0296327 | A1 * | 12/2008 | Murdoch et al. | 224/195 |

* cited by examiner

CONFORMING BANDS, BELTS, AND HOLSTERS WITH INTEGRATED POUCHES

CROSS-REFERENCE TO RELATED APPLICATIONS

This nonprovisional patent claims the benefit of U.S. Provisional Patent Application Ser. No. 61/312,237, entitled "Cushioned and conforming body band with integrated concealed holster." filed on Mar. 9, 2010, which is hereby incorporated herein by reference in its entirety including all references cited therein.

FIELD OF THE INVENTION

The present technology relates generally to a holster for concealing weapons, and more specifically, but not by way of limitation, a holster for concealing a firearm. In some embodiments, the holster may be adapted to fit securely around at least a portion of an individual and substantially obscure the presence of a firearm that is disposed within an integrally formed pouch.

BACKGROUND

Conceal and carry weapon holsters currently available, although functional for some activities, generally are not functional or comfortable for use with physical activities of a higher level. Moreover, they are not practical or comfortable enough for use during sleep. Currently available soft conceal carry holsters tend to bounce with activity, which can expose the weapon and become uncomfortable. Hard case holsters tend to provide a surface on which clothing may become snagged or ensnared. External "fanny pack" style holsters are problematic with exercise because the belt tends to loosen with prolonged activity and may require frequent adjustment.

Another problem with fanny pack style holsters is that they are not truly a concealing devise. To some, the fanny pack is an indication that the user may be carrying a weapon.

Currently available "belly band" holsters do not entirely enclose the gun thus the gun could become snagged on clothing or rub against the skin causing irritation. Another limitation of currently available belly band holsters is that they are of one width the entire length of the holster thus producing a larger footprint, increase heat generation, reducing comfort and they are not perspiration resistant.

In contrast, the present technology may include bands and belts with integrated holster that can completely encase the contents of the pouches without allowing any portion of the pouch contents to become exposed, even with movement. Exemplary devices described herein may include integrated holsters that give the user the ability to adjust the effective size of the pouch and have flexibility in the position of the weapon within the holster. Also, exemplary devices provided herein may include soft body portions with cloth backing that are comfortable enough for all-day wear.

SUMMARY OF THE INVENTION

According to some embodiments, a conforming band may include a body portion adapted to surround at least a portion of an individual, the body portion having an outer surface and an inner surface, the body portion including an integrally formed pouch, the pouch including at least two sidewalls that are spaced apart from one another and joined together along a common bottom edge to define a cavity for receiving one or more objects.

In other embodiments, a securement member may be adapted to retain a firearm within the pouch when the firearm is inserted into the pouch, the securement member being disposed proximate top edges of the at least two sidewalls.

In some embodiments, the securement member may include a strap that includes a first end and a second end, wherein the first end of the strap is fixedly attached to one of the at least two sidewalls and the second end of the strap is releasably securable to another of the at least two sidewalls.

In other embodiments, the securement member includes a pair of magnetically attracted objects, wherein one of the pair of magnetically attracted objects is associated with one of the at least two sidewalls and a second of the pair of magnetically attracted objects is associated with another of the at least two sidewalls, wherein when the at least two sidewalls are brought together, the pair of magnetically attracted objects join with one another to enclose the pouch.

In additional embodiments, the holster may further comprise one or more additional sidewalls disposed between the at least two sidewalls for subdividing the pouch into compartments.

In some embodiments, at least one of the one or more additional sidewalls is constructed from a tear resistant material.

In some applications, the body portion includes a first end, a second end, a length extending therebetween and a height that is transverse the length, wherein the first and second ends are adapted to cooperate together to releasably secure the body portion around at least a portion of an individual, further wherein the height of the second end is less than the height of the first end.

In other embodiments, at least a portion of the body portion is perforated to allow for fluid flow from the inner surface to the outer surface and a diameter of the body portion is selectively adjustable.

In some embodiments, top edges of the at least two sidewalls are outwardly flared from one another to facilitate insertion and removal of the at least a portion of the firearm within the pouch.

In additional embodiments, the portion of the body portion forming the pouch includes a substantially waterproof material, and the body portion further includes at least one selectively adjustable support strap adapted to overlap a shoulder of an individual when the body portion is secured to at least a portion of the individual.

According to other embodiments, the present technology may include conforming bands that comprise (a) a strap having an outer surface and an inner surface, the strap includes opposing ends for releasably securing the conforming band around at least a portion of an individual, wherein at least a portion of the strap includes two or more integrally formed pouches, wherein each of the two or more pouches includes at least two sidewalls that are spaced apart from one another and joined together along a common bottom edge to define a cavity for receiving a firearm; and (b) a securement member adapted to retain a firearm within the pouch when a firearm is inserted into the pouch, the securement member being disposed proximate top edges of the at least two sidewalls.

In other embodiments, each of the two or more pouches is disposed side-by-side along a length of the strap, and each of the two or more pouches includes one or more additional sidewalls disposed between the at least two sidewalls for subdividing the pouch into compartments.

In some additional aspects, the present technology may include holsters adapted to conform to at least a portion of a torso of an individual. The holsters may include (a) a body portion having a first end and a second end spaced apart from one another to define a length, the body portion including an integrally formed pouch disposed between the first and second ends, the pouch including at least two sidewalls that are spaced apart from one another and joined together along a common bottom edge to define a cavity for receiving a firearm; and (b) wherein the first end is adapted to overlap at least a portion of the second end and releasably associate with the second end to selectively vary a diameter of the body portion to bring the body portion into conforming contact with the at least a portion of the torso of the individual to prevent movement of the pouch relative to the torso of the individual.

BRIEF DESCRIPTION OF THE DRAWINGS

Certain embodiments of the present invention are illustrated by the accompanying figures. It will be understood that the figures are not necessarily to scale and that details (e.g., dimensions) not necessary for an understanding of the invention or that render other details difficult to perceive may be omitted. It will be understood that the invention is not necessarily limited to the particular embodiments illustrated herein.

DETAILED DESCRIPTION OF EXEMPLARY EMBODIMENTS

Figure 1:
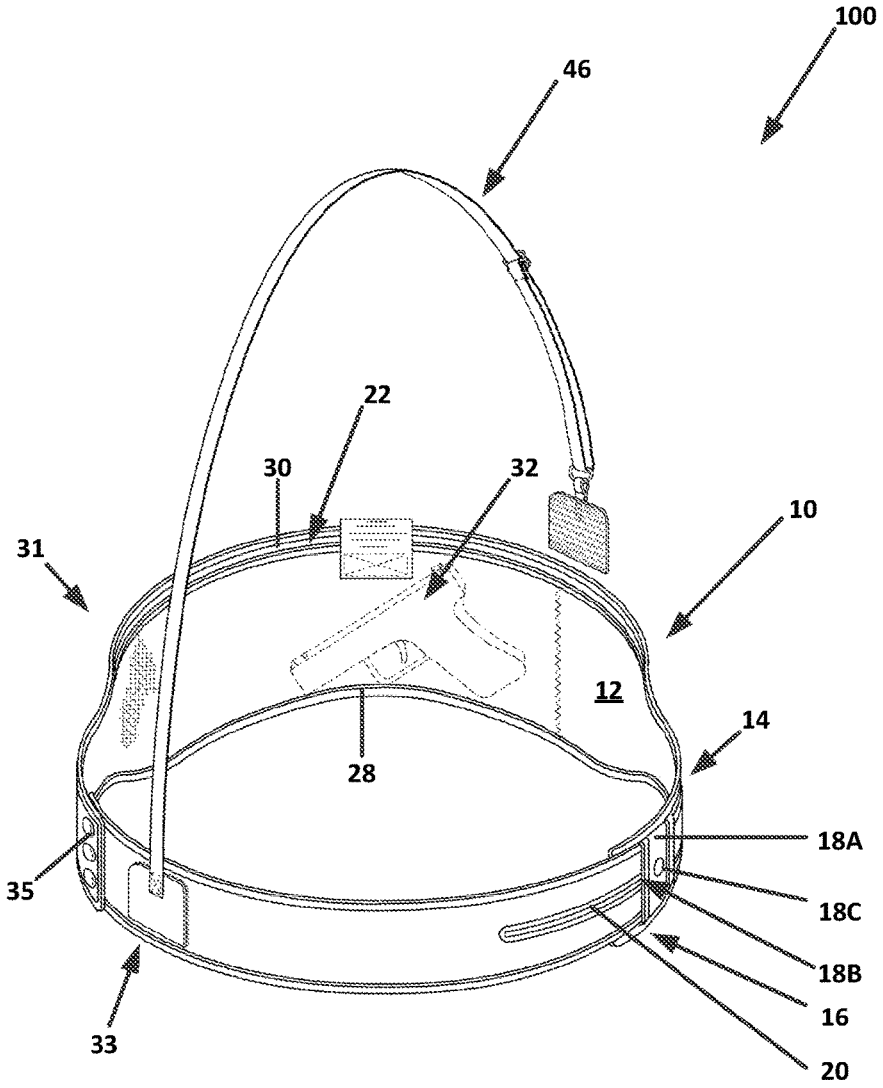
FIG. 1 is a perspective view of a conforming band with an optional support strap, constructed in accordance with the present disclosure.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

Referring now to the collective drawings, and in particular to FIG. 1, a conforming band 100 is shown as generally including a body portion 10 having an integrally formed pouch. In some embodiments, the conforming band 100 may also be referred to as a belt, a strap, or a holster. According to some embodiments, the body portion 10 may be constructed from a resilient and conforming material such as an elastomeric material, a natural material such as leather, rubber, and the like, a textile such as cloth, or a composite material such as Kevlar. In some embodiments, the body portion 10 may be constructed from synthetic materials such as neoprene.

Because some of the embodiments of the conforming band 100 may require the body portion 10 to conformingly surround the body of an individual, the body portion 10 may be perforated to allow for air to pass through the perforations of the body portion 10 to prevent excess moisture from developing between the body portion 10 and the body of the individual. In some embodiments, the body portion 10 may be of sufficient length to surround at least a portion of the torso (e.g., abdomen) of the individual, although the body portion 10 may likewise be adapted to conformingly surround a leg or an arm of the individual.

In some embodiments, the body portion 10 may include a cushioning material disposed on an inner surface 12 of the body portion to prevent chafing between the body portion 10 and the individual. Moreover, the cushioning material allows for the body portion 10 to be resized and rotated around the torso of the individual without causing discomfort to the individual.

Referring now to FIGS. 1-7 collectively, the body portion 10 includes a first end 14 and a second end 16 that are spaced apart from one another to define a length L therebetween. The first end 14 of the body portion 10 may include a bridge 18A that includes a safety tab 18B. The bridge 18A is spaced apart from the body portion 10 of the first end 14 to form a slot 18C for receiving at least a portion of the second end 16 therein.

Although not shown, the safety tab 18B may include a post that extends from the body portion 10 into the slot 18C, and a head that has a larger diameter than the diameter of the post. When the second end 16 overlaps the first end 14, the head of the safety tab 18B may be forcibly inserted into a groove 20 formed in the second end 16. The groove 20 of the second end 16 may extend laterally along at least a portion of the length L of the body portion 10.

To secure the first end 14 to the second end 16, the second end 16 is inserted into the slot 18C such that the safety tab 18B of the first end 14 is aligned with the groove 20 of the second end 16. The head of the safety tab 18 may be forcibly inserted through the groove 20 to prevent unintentional decoupling of the first end 14 and the second end 16. This functionality ensures that the body portion 10 remains secured around the individual upon the failure of additional securement members associated with the body portion 10.

Additional securement members may include hook and loop type fasteners that are associated with the first end 14 and the second end 16 to quickly and releasably secure the first end 14 and the second end 16 together. One of ordinary skill in the art will appreciate that other types of releasable fasteners (e.g., buttons, snaps, clips, and so forth) may likewise be utilized in accordance with the present technology.

Because the second end 16 may be adapted to at least partially overlap the first end 14 and releasably associate with the second end 16 via one or more securement members, the diameter of the body portion 10 may be selectively varied to bring the body portion 10 into conforming contact with the at least a portion of the torso of the individual to prevent movement of the body portion 10 relative to the torso of the individual.

In additional embodiments, the first end 14 of the body portion 10 may include a different geometrical configuration from the second end 16. For example, a height h1 of the first end 14 may be larger relative to the height h2 of the second end 16 to ensure that the first and second ends 14 and 16 properly align. Moreover, because the second end 16 may include hook type fasteners that cooperate with loop type fasteners associated with first end 14, the larger size of the first end 14 relative to the second end 16 may prevent the hook type fasteners associated with the second end 16 from contacting the torso of the individual.

In some embodiments, the body portion 10 includes an integrally formed pouch 22. The pouch 22 may include a first sidewall 24 and a second sidewall 26 that are spaced apart from one another and are joined together along a common bottom edge 28 to define a cavity 30. In some embodiments, the cavity 30 is adapted to receive and retain a firearm 32 therein.

According to some embodiments, the body portion 10 may be separated into two portions 31 and 33 that are joined together via one or more fasteners 35, which in some embodiments includes buttons, snaps, hooks, and clips—just to name a few. The releasable association between the two portions 31 and 33 of the body portion 10 may allow individuals to don and doff the body portion 10 with relative ease. As such, the operative connection between the first and second ends 14 and 16 may be utilized to size the conforming band 100 to the torso of the individual rather than utilizing the first and second ends 14 and 16 during donning and doffing of the conforming band 100. Stated otherwise, separation of the body portion 10 into portions 31 and 33 may reduce wear and tear to the first and second ends 14 and 16.

The pouch 22 may be constructed from the same material as the body portion 10, or may include a layer of tear resistant material such as a polymer (e.g., low density polyethylene) along the inner surfaces of both the first and second sidewalls 24 and 26, respectively. The tear resistant material may operate to substantially prevent sharp objects housed within the pouch 22 from tearing through the sidewalls of the pouch 22. Moreover, in some applications, the tear resistant material may be provided to prevent objects outside the pouch 22 from unwanted contact with objects housed within the pouch 22, for example, to prevent engagement of the trigger of the firearm 32. Additionally, the tear resistant material may be provided to prevent protrusions or other sharp edges of objects contained within the pouch 22 from contacting the torso of the individual.

Because the pouch 22 may be adapted to receive and retain a firearm, the sidewalls of the pouch 22 may be constructed from a bulletproof composite material such as Kevlar, ceramics, nanomaterials, and the like.

Figures 2, 3, 4:
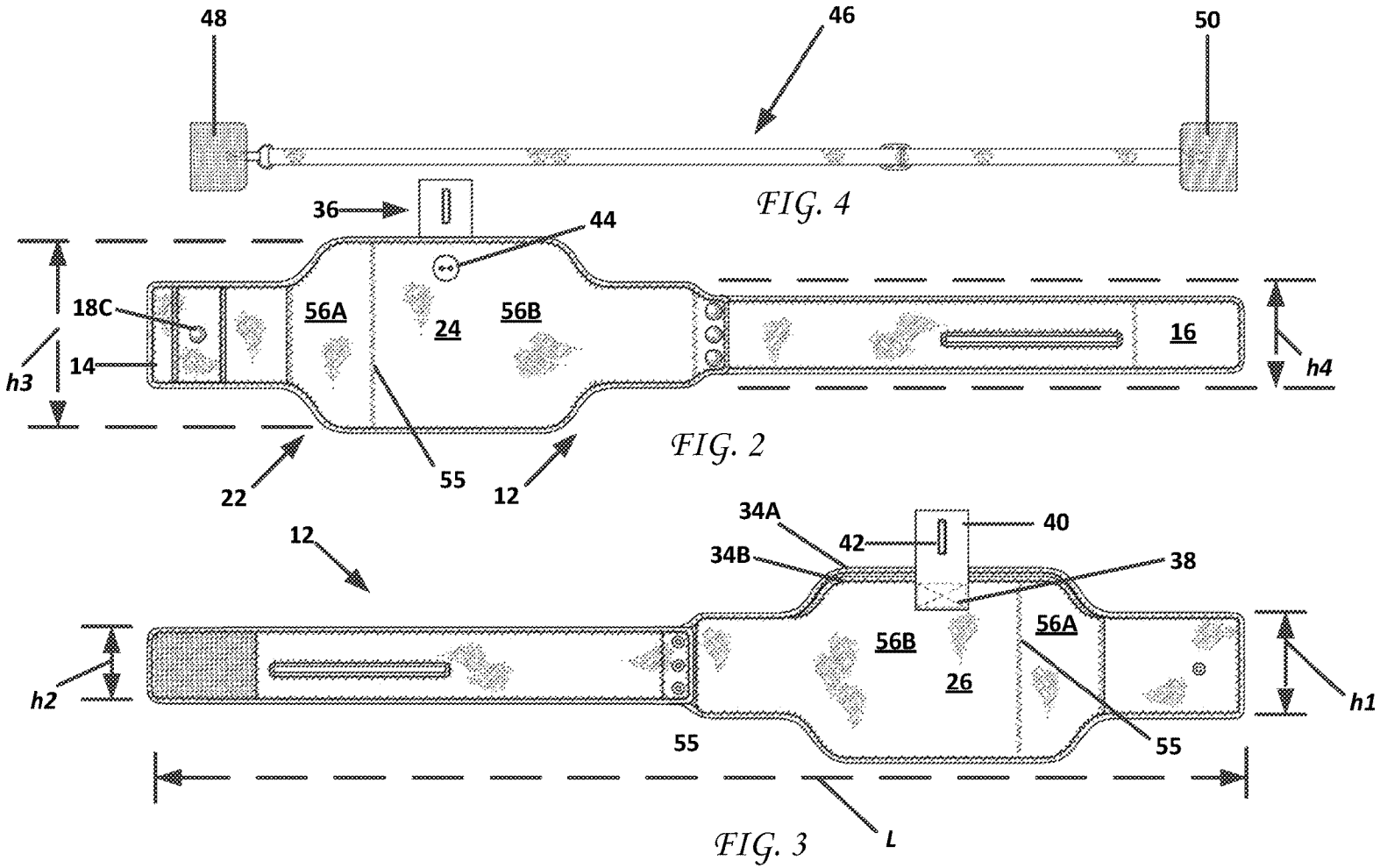
FIG. 2 is a front elevational view of the conforming band of FIG. 1, the conforming being shown in a flat position.
FIG. 3 is a rear elevational view of the body portion of FIG. 2.
FIG. 4 is a front elevational view of a support strap of the conforming band of FIG. 1.
Figure 5:
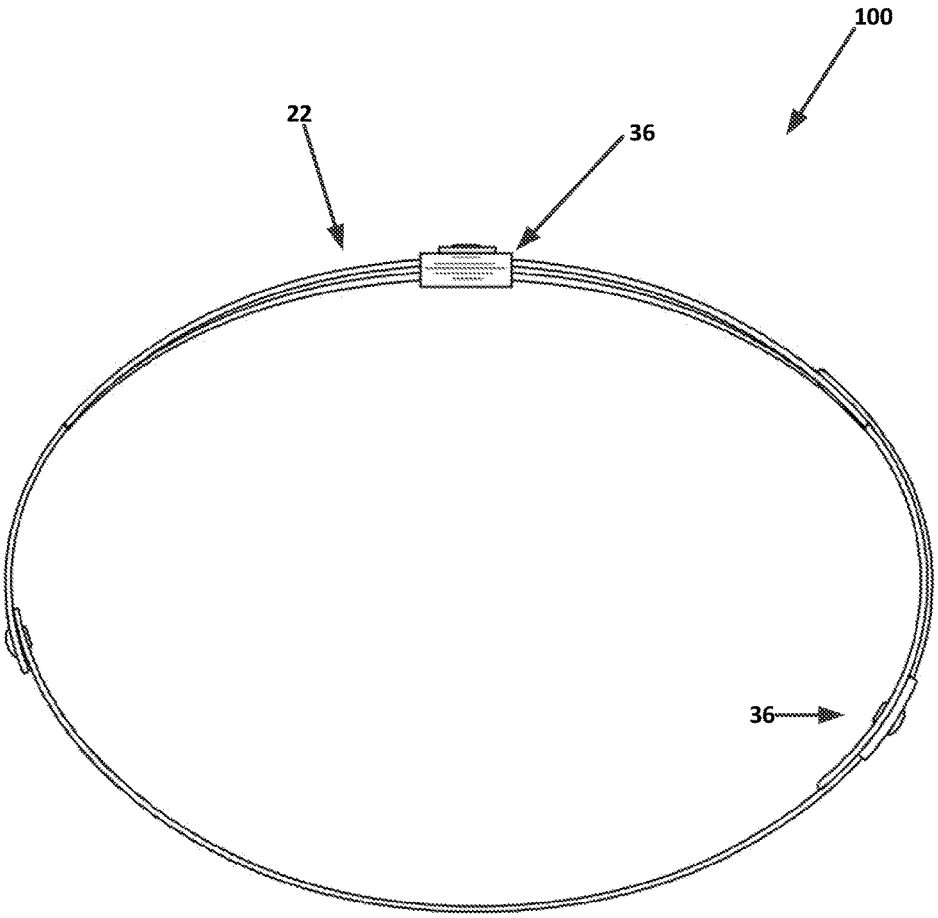
FIG. 5 is a top down view of the conforming band of FIGS. 2 and 3.
Figure 6:
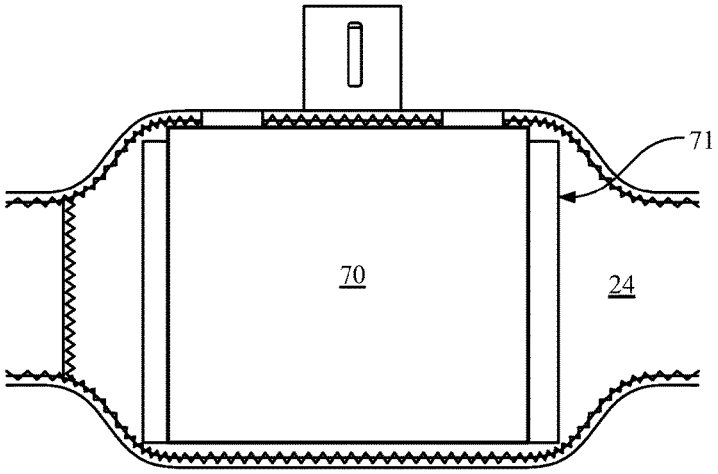
FIG. 6 is a front elevational view of a portion of a conforming band in association with a stiffener device.
Figure 7:
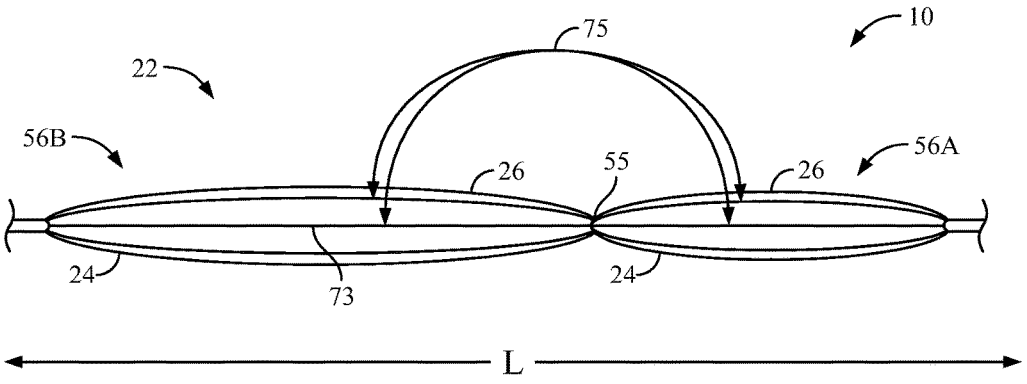
FIG. 7 is a top down view of a portion of a conforming band showing a plurality of compartments.

According to some embodiments, each of the first and the second sidewalls 24 and 26 include a top edge 34A and 34B, respectively. Additionally, the top edges 34A and 34B of the first and second sidewalls 24 and 26 may be outwardly flared from one another to facilitate efficient insertion and removal of objects within the cavity 30. As is best shown in FIG. 3, the top edge 34A of the first sidewall 24 may be positioned above the top edge 34B of the second sidewall 26. When the body portion 10 is secured around the torso of the individual, the top edge 34A of the first sidewall 24 may be urged closer to the torso of the individual to at least partially cover the top edge 34B of the second sidewall 26 and enclose the cavity 30.

In various embodiments, the pouch 22 may include a tapered configuration transitioning from a height h3 proximate the midline of the pouch 22 to a second height h4 towards the outer edges of the pouch 22. The difference in heights creates a geometrical configuration that enhances the ability of the pouch 22 to lie flat against the torso of the individual when the body portion 10 is urged against the torso.

In accordance with the present disclosure, the body portion 10 may include a securement member 36 that is adapted to join the sidewalls 24 and 26 together to securely retain objects within the pouch 22. For example, the securement member 36 may include a strap of material that having a first end 38 that is fixedly attached to the outer surface of the second sidewall 26. A second end 40 of the securement member 36 may include a slit 42 that is adapted to cooperate with a button 44 disposed on the outer surface of the first sidewall 24. During use, the securement member 36 may overlap the top edges 34A and 34B of the first and second sidewalls 24 and 26. Additionally, the second end 40 of the securement member 36 may cooperate with the button 44 to releasably retain objects within the pouch 22.

In some embodiments, the button 44 may include a magnetic object (e.g., a magnetic button) that is adapted to cooperate with a magnetic object, such as a magnetic snap, that is disposed on the second end 40 of the securement member 36 to releasably retain objects within the pouch 22.

For example, when the firearm 32 is inserted into the pouch 22, the securement member 36 may overlap the top edges 34A and 34B of the first and second sidewalls 24 and 26 to enclose the firearm 32 within the cavity 30 of the pouch 22. Once the button 44 is passed through the slit 42 of the securement member 36, the firearm 32 is retained within the pouch 22. Although the body portion 10 is described as including a securement member 36 that includes a strap of material adapted to cooperate with a button, one of ordinary skill in the art with the present disclosure before them will appreciate that many other types of securement members may be utilized to join the first and second sidewalls 24 and 26 together.

For example, although not shown, the body portion 10 may utilize magnetic objects associated with each of the first and second sidewalls 24 and 26. When the first and second sidewalls 24 and 26 are brought together, the magnetic objects associated with the first and second sidewalls 24 and 26 attract to one another and magnetically couple the top edges 34A and 34B of the first and second sidewalls together.

The pouch 22 may include one or more additional sidewalls 55 (see FIGS. 2, 3, and 7) disposed between the first and second sidewalls 24 and 26. The one or more additional sidewalls may extend longitudinally between the inner surfaces of the first and second sidewalls 24 and 26, or may alternatively extend laterally (see 73 of FIG. 7) along the length L of the body portion 10 to subdivide the pouch 22 into one or more pouches 75 (also see FIG. 7).

In additional embodiments, the body portion 10 may include two or more pouches disposed side-by-side relative to one another (see 56A and 56B of FIGS. 2 and 3). These two or more pouches may be constructed similarly to pouch 22.

In other embodiments, the size of the pouch 22 may be modified by disposing one or more double sided strips of hook fasteners (not shown) within the pouch 22. The one or more double sided strips of hook fasteners may contact each of the inner surfaces of the sidewalls 24 and 26. That is, the material that lines the inner surfaces of the sidewalls 24 and 16 may be adapted to cooperate with hook fasteners to subdivide the cavity 30 of the pouch 22 into one or more sections.

The body portion 10 may also include a series of loops of elastomeric material associated with at least one of the inner surface and the outer surface of the body portion 10 to securely retain additional objects such as ammunition clips, firearms, firearm accessories, and so forth.

The conforming band 100 may optionally include one or more support straps 46 that are adapted to overlap the shoulder of the individual when the body portion 10 conformingly surrounds the torso of the individual. The one or more support straps 46 may include a first end 48 and a second end 50. The first and second ends 48 and 50 are adapted to releasably associate with the outer surface or inner surfaces of the body portion 10. Moreover, the one or more support straps 46 may be selectively adjusted to accommodate different individuals with torsos of differing size.

In operation, the conforming band 100 may be joined to the torso of the individual by wrapping the body portion 10 around the torso of the individual. Because the body portion 10 is created from a resilient and conforming material, the body portion 10 (and the contents of the pouch 22) may lay flat against the torso of the individual (e.g., conform to the torso of the individual) as the body portion 10 is urged against the torso.

Stated otherwise, the body portion 10 may be urged against the torso by overlapping the second end 16 with the first end 14 to selectively vary a diameter of the body portion 10 and bring the body portion 10 into conforming contact with the torso. The conforming contact of the body portion 10 with the torso of the individual may substantially prevent movement of the pouch 22 relative to the torso.

Because the body portion 10 conformingly surrounds the torso of the individual, movement of the body portion 10 relative to torso of the individual is substantially eliminated. Therefore, the body portion 10 may be secured in place on the torso of the individual despite movement of the individual. Moreover, because the body portion 10 conforming contacts the torso of the individual, the contents disposed within the pouch 22 may lay flat against the torso of the individual. As such, the holster 100 of the present technology may operate to conceal firearms more effectively than holsters that do not conformingly surround the torso of the individual.

The conforming contact of the body portion 10 with the torso may be securely maintained by inserting the second end 16 of the body portion 10 into the slot 18C of the first end 14 to lock the body portion 10 into its current configuration. Hook and loop fasteners associated with the first and second ends 14 and 16 may join the first and second ends 14 and 16 together. For a more secure connection, the safety tab 18B of the first end 14 may be inserted into the groove 20 of the second end 16.

Figure 8:
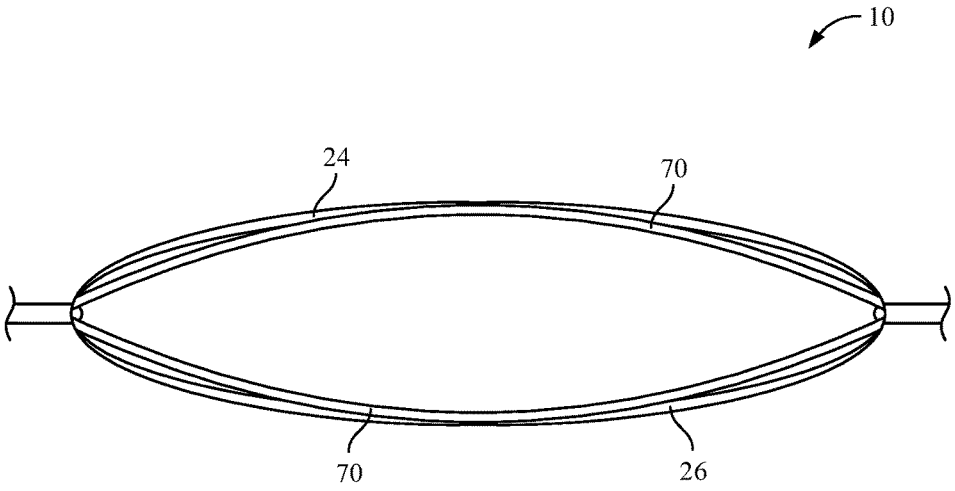
FIG. 8 illustrates a top down view of a pouch with stiffener devices on outer and inner sidewalls.

Additionally, in some embodiments, portions of the pouch 22 may be formed from a stiffened material to prevent visual apprehension of protrusions or the peripheral outline of the firearm 32 when the conforming band 100 is associated with the individual. For example, a layer of stiffening material 70 may be applied to the inner surface of the outermost sidewall 24 to prevent printing of the contents disposed within the pouch 22. In a multi-pouch embodiment a conformable "gouge" preventing material (LDPE low density polyethylene plastic in the preferred embodiment attached using adhesive or a Velcro type fastener) is attached to the inside wall of the small magazine/speed load pouch thus preventing the contents of this pouch from gouging the user. This allows a thinner material to be used in the construction of the pouch wall. In addition, other items such as pouches for magazines/speed loaders or a pouch barrier for the rear panel of the large pouch could be attached with hook Velcro-like material 71. The stiffener devices, such as the stiffener device 70 of FIG. 6, may be required for smaller belt designs (such as could be found in a single pouch embodiment) and would be constructed from a material such as LDPE. The purpose of these devices is to limit the ability of the wall to collapse under load, yet retain the needed conformability of the holster. FIG. 8 illustrates another example pouch of a body portion 10 of a conforming band. The body portion 10 comprises a first layer of stiffening material 70 that is attached to an outermost sidewall 24 and a second layer of stiffening material 70 that is attached to an sidewall 26 of the pouch. These layers of stiffening material can be attached using any of the aforementioned methods.

While the above described embodiments contemplate the use of the holster 100 for concealing firearms, the conforming band 100 may be likewise utilized to conceal other types of object such as jewelry, a wallet, passport, identification cards, bankcards, cell phones, cash clips, sensitive documents, and so forth.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art.

What is claimed is:

1. A conforming band, comprising:

a body portion adapted to surround at least a portion of an individual, the body portion having an outer surface and an inner surface, the body portion including an integrally formed pouch, the pouch including at least two sidewalls that are spaced apart from one another and joined together along a common bottom edge to define a cavity for receiving one or more objects, the pouch having a tapered configuration transitioning from a height at a midline of the pouch to a second height at opposing ends of the pouch to aid the pouch in conforming to a torso of a user when in use, wherein the at least two sidewalls constructed from an elastomeric material to also facilitate conforming of the pouch to the torso of the user and compression of contents included in the pouch;

a first securement member comprising a strap forming a loop, on a first end of the body portion, the strap comprising an aperture for receiving a securement tab comprising a head and a post, the head having a diameter that is greater than a diameter of the post, the second end comprising an elongated groove that extends along the length of the body portion, the securement tab being mounted onto the first end underneath the strap, wherein a second end of the body portion is insertable through the loop formed by the strap, the securement tab is inserted through the elongated groove and through the aperture to slidingly and securely couple the first end and the second end together to for sizing of the body portion relative to the torso of the individual, wherein a diameter of the body portion is selectively adjustable based on sliding of the securement tab within the elongated groove when the second end is pulled; and wherein the second end comprises an inner surface having hook or loop fasteners, the second end overlaps the portion of the outer surface of the body portion as a second securement member; and wherein the first securement member keeps the body portion secured around the torso of the individual if the second end decouples from the body portion.

2. The conforming band according to claim 1, further comprising a securement member adapted to retain a firearm within the pouch when the firearm is inserted into the pouch, the securement member being associated with top edges of the at least two sidewalls and being adapted to overlap the top edges of the at least two sidewalls to releasably secure the top edges together.

3. The conforming band according to claim 2, wherein the securement member includes a strap that includes a first end and a second end, wherein the first end of the strap is fixedly attached to one of the at least two sidewalls and the second end of the strap is releasably securable to another of the at least two sidewalls.

4. The conforming band according to claim 2, wherein the securement member includes a pair of magnetically attracted objects, wherein one of the pair of magnetically attracted objects is associated with one of the at least two sidewalls and a second of the pair of magnetically attracted objects is associated with another of the at least two sidewalls, wherein when the at least two sidewalls are brought together, the pair of magnetically attracted objects join with one another to enclose the pouch.

5. The conforming band according to claim 1, further wherein the pouch is subdivided into side-by-side compartments arranged along a length of the body portion.

6. The conforming band according to claim 5, wherein at least one of the first and second sidewalls and one or more additional sidewalls that extends between the first and second sidewalls is constructed from a tear resistant material.

7. The conforming band according to claim 1, wherein the body portion includes a first end, a second end, a length extending therebetween and a height that is transverse the length, wherein the first and second ends are adapted to cooperate together to releasably secure the body portion around at least a portion of an individual, further wherein the height of the second end is less than the height of the first end and the first and second ends include hook and loop fasteners.

8. The conforming band according to claim 1, wherein at least a portion of the body portion is perforated to allow for fluid flow from the inner surface to the outer surface.

9. The conforming band according to claim 7, wherein the second end overlaps at least a portion of the first end to selectively vary a diameter of the body portion.

10. The conforming band according to claim 1, wherein top edges of the at least two sidewalls are outwardly flared from one another to facilitate insertion and removal of the one or more objects within the pouch.

11. The conforming band according to claim 1, wherein the integral pouch is at least partially constructed from a waterproof material.

12. The conforming band according to claim 1, wherein the body portion further includes at least one selectively adjustable support strap adapted to overlap a shoulder of an individual when the body portion is secured to the at least a portion of the individual.

13. The conforming band according to claim 12, wherein the at least one support strap includes a first tab and a second tab, wherein the first tab adapted to releasably attach to a first sidewall of the body portion, the first sidewall being one of the at least two sidewalls.

14. A conforming belt, comprising:

a body portion an outer surface and an inner surface, the body portion including opposing ends for releasably securing the conforming belt around at least a portion of an individual, wherein the body portion includes two or more integrally formed pouches, wherein each of the two or more pouches includes at least two sidewalls that are spaced apart from one another and joined together along a common bottom edge to define a cavity for receiving one or more objects, wherein the two or more pouches are disposed side-by-side along a length of the body portion, wherein the at least two sidewalls of each of the two or more pouches constructed from an elastomeric material to facilitate conforming of the pouches to the torso of the user and compression of contents included in the pouches;

a first securement member comprising a strap forming a loop, on the first end of the opposing ends, the strap comprising an aperture for receiving a securement tab comprising a head and a post, the head having a diameter that is greater than a diameter of the post, the second end comprising an elongated groove that extends along the length of the body portion, the securement tab being mounted onto the first end underneath the strap, wherein the second end of the opposing ends is insertable through the loop formed by the strap, the securement tab is inserted through the elongated groove and through the aperture to slidingly and securely couple the first end and the second end together to for sizing of the body portion relative to the torso of the individual, wherein a diameter of the body portion is selectively adjustable based on sliding of the securement tab within the elongated groove when the second end is pulled; and wherein the second end comprises an inner surface having hook or loop fasteners, the second end overlaps the portion of the outer surface of the body portion as a second securement member; and wherein the first securement member keeps the body portion secured around the torso of the individual if the second end decouples from the body portion;

a first stiffener releasably attached to an inner surface of an outermost sidewall of the at least two sidewalls of a first of the two or more pouches, the first stiffener prevents visual apprehension of an outline of a firearm disposed within the cavity, a second stiffener releasably attached to an inner surface of an innermost sidewall of the at least two sidewalls of the first of the two or more pouches, the second stiffener limiting an ability of the innermost sidewall to collapse under load as well as retain conformability by the conforming band; and a third securement member adapted to retain the one or more objects within the first pouch when the firearm is inserted into the pouch, the third securement member being disposed proximate top edges of the at least two sidewalls of the first pouch, the third securement member adapted to overlap the top edges of the at least two sidewalls to enclose the one or more objects within the first pouch.

15. The conforming belt according to claim 14, wherein at least one of the at least two sidewalls is constructed from a bulletproof material.

16. A holster adapted to conform to at least a portion of a torso of an individual, the holster comprising:

a body portion having a first end and a second end spaced apart from one another to define a length, the body portion including an integrally formed pouch disposed between the first and the second ends, the pouch including at least two sidewalls that are spaced apart from one another and joined together along a common bottom edge to define a cavity for receiving a firearm, wherein a portion of an outer surface of the body portion is provided with hook or loop fasteners;

a first securement member comprising a strap forming a loop, a securement tab on the first end, the strap comprising an aperture for receiving a securement tab comprising a head and a post, the head having a diameter that is greater than a diameter of the post, the second end comprising an elongated groove that extends along the length of the body portion, the securement tab being mounted onto the first end underneath the strap, wherein the second end is inserted through the loop formed by the strap, the securement tab is inserted through the elongated groove and through the aperture to slidingly and securely couple the first end and the second end together to for sizing of the body portion relative to the torso of the individual, wherein a diameter of the body portion is selectively adjustable based on sliding of the securement tab within the elongated groove when the second end is pulled; and wherein the second end comprises an inner surface having hook or loop fasteners, the second end overlaps the portion of the outer surface of the body portion as a second securement member; and wherein the first securement member keeps the body portion secured around the torso of the individual if the second end decouples from the body portion.

17. The holster according to claim 16, wherein the body portion may include a first section and a second section, further wherein the first section is releasably connectable to the second section.

18. The holster according to claim 16, wherein the at least two sidewalls comprise a first sidewall that is formed of a stiffened material and a second sidewall that is formed from an elastomeric material.

19. The holster according to claim 16, further comprising another sidewall extending between the at least two sidewalls and extend laterally along the length of the body portion, wherein the at least two sidewalls and the another sidewall are joined together so as to form a plurality of separate compartments.

* * * * *